US008121515B2

(12) United States Patent
Matsui et al.

(10) Patent No.: US 8,121,515 B2
(45) Date of Patent: Feb. 21, 2012

(54) IMAGE-FORMING APPARATUS

(75) Inventors: Toshiyuki Matsui, Ebina (JP); Hiroki Ando, Ebina (JP); Satoshi Honobe, Ebina (JP); Tsuneo Fukuzawa, Ebina (JP); Tomonori Sato, Ebina (JP); Fumiaki Maekawa, Ebina (JP); Yoshiyuki Takashima, Ebina (JP); Junichirou Sameshima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 72 days.

(21) Appl. No.: 12/795,411

(22) Filed: Jun. 7, 2010

(65) Prior Publication Data

US 2011/0116830 A1 May 19, 2011

(30) Foreign Application Priority Data

Nov. 19, 2009 (JP) ..... 2009-263586

(51) Int. Cl.
*G03G 15/00* (2006.01)

(52) U.S. Cl. ..... 399/107

(58) Field of Classification Search ..... 399/107, 399/116, 96, 105, 299, 306, 166
See application file for complete search history.

(56) References Cited

U.S. PATENT DOCUMENTS

| | | | | |
|---|---|---|---|---|
| 5,572,307 | A * | 11/1996 | Tomatsu et al. | 399/122 |
| 7,894,743 | B2 * | 2/2011 | Tomatsu | 399/107 |
| 2004/0170446 | A1 | 9/2004 | Nagashima et al. | |
| 2005/0220481 | A1 | 10/2005 | Yamaguchi et al. | |
| 2005/0281594 | A1 | 12/2005 | Kuma et al. | |
| 2006/0239712 | A1 | 10/2006 | Yamaguchi et al. | |
| 2006/0285879 | A1 | 12/2006 | Yamaguchi et al. | |
| 2008/0003015 | A1 * | 1/2008 | Tomatsu | 399/110 |
| 2009/0180799 | A1 | 7/2009 | Yamaguchi et al. | |
| 2009/0297220 | A1 * | 12/2009 | Tanda et al. | 399/119 |
| 2010/0014887 | A1 * | 1/2010 | Tomatsu et al. | 399/107 |

FOREIGN PATENT DOCUMENTS

| | | | |
|---|---|---|---|
| JP | 2004-212986 | A | 7/2004 |
| JP | 2005-266781 | A | 9/2005 |
| JP | 2006-3735 | A | 1/2006 |

* cited by examiner

*Primary Examiner* — Kiho Kim

(74) *Attorney, Agent, or Firm* — Sughrue Mion, PLLC

(57) ABSTRACT

An image-forming apparatus includes: first and second frame members opposing each other; image-holding members each having a rotation shaft; a supporting unit provided to the first frame member and having insertion holes each supporting an end portion of a rotation shaft of a corresponding image-holding member inserted in an insertion direction from the second frame member to the first frame member; and flat elastic bodies provided to the respective insertion holes, each flat elastic body having a plate member bent to form: an attachment part attached to the supporting unit; a leg part extending from the attachment part in the direction opposite to the insertion direction; and an elastic part extending from the leg part in the insertion direction through the insertion hole to press the end portion of the rotation shaft at a position spaced apart from the insertion hole in the insertion direction.

4 Claims, 6 Drawing Sheets

60
61
62
63
64
65
53
55
50
3A
b
X
Y(+)
Y(-)
Z(+)
Z(-)

IMAGE-FORMING APPARATUS

CROSS-REFERENCE TO RELATED APPLICATIONS

This application is based on and claims priority under 35 U.S.C. 119 from Japanese Patent Application No. 2009-263586, which was filed on Nov. 19, 2009.

BACKGROUND

1. Technical Field

The present invention relates to an image-forming apparatus.

2. Related Art

In some image-forming apparatuses, a process cartridge, which is a unit including an image-holding member that holds an image, is detachably attached to a main body of the apparatus.

SUMMARY

In one aspect of the present invention, there is provided an image-forming apparatus including: a housing including a first frame member and a second frame member opposed to the first frame member; plural image-forming units each including an image-holding member on which an image is formed, the image-holding member having a rotation shaft; a supporting unit provided to the first frame member, the supporting unit having plural insertion holes each receiving and supporting an end portion of a rotation shaft of a corresponding one of the plural image-holding members inserted in an insertion direction from the second frame member to the first frame member; and plural flat elastic bodies provided to the respective insertion holes, each flat elastic body having a plate member that is bent to form: an attachment part that is attached to a surface of the supporting unit facing in a direction opposite to the insertion direction; a leg part extending from the attachment part in the direction opposite to the insertion direction; and an elastic part extending from the leg part in the insertion direction through the insertion hole to press the end portion of the rotation shaft against an edge of the insertion hole at a position spaced apart from the insertion hole in the insertion direction.

BRIEF DESCRIPTION OF THE DRAWINGS

Exemplary embodiments of the present invention will now be described in detail with reference to the following figures, wherein.

DETAILED DESCRIPTION

1. Exemplary Embodiment

Figure 1:
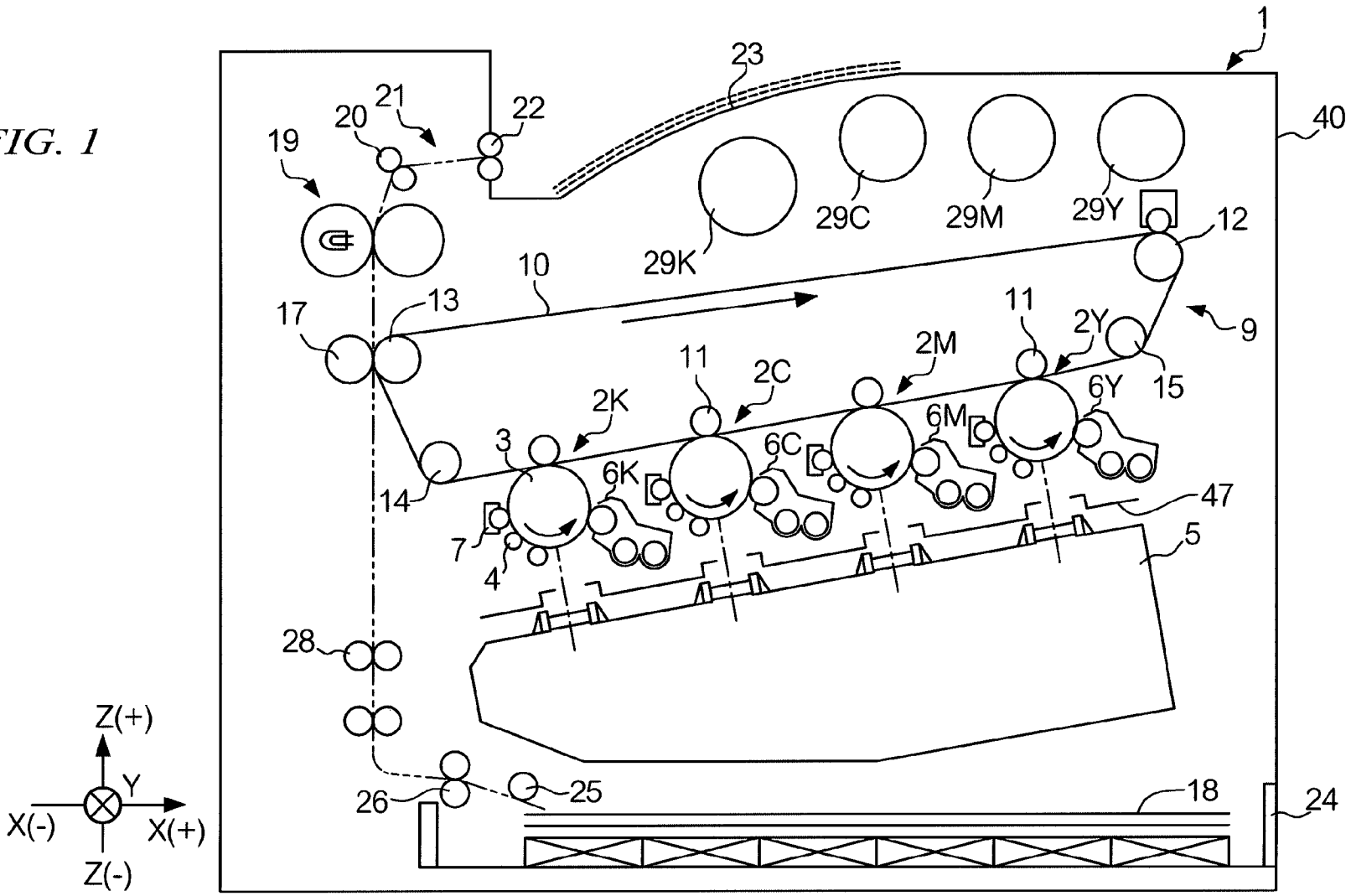
FIG. 1 schematically shows a configuration of an image-forming apparatus according to an exemplary embodiment of the present invention.

An image-forming apparatus, such as a printer or a copy machine, is provided with a cover on a front or lateral side of a housing, for example, in such a manner that the cover can be opened and closed to facilitate maintenance or replacement of a component part, or removal of a jammed sheet. In the following, taking such an image-forming apparatus as an example, explanation will be made of an exemplary embodiment of the present invention. FIG. 1 schematically shows a configuration of an image-forming apparatus according to the exemplary embodiment. In the following description, as indicated in the drawings, when the image-forming apparatus is viewed from its front by a user, the horizontal direction is denoted as the X-axis direction, with right/left directions from the user's perspective being indicated by X(+) and X(−), respectively; the front-back direction of the image-forming apparatus is denoted as the Y-axis direction, with back/front directions of the image-forming apparatus being indicated by Y(+) and Y(−), respectively; and the vertical direction is denoted as the Z-axis direction, with up/down directions being indicated by Z(+) and Z(−), respectively. It is to be noted that unless otherwise indicated, a term "inward" indicates a direction with respect to frames 43, 44, which will be described later, toward a space in which an exposure device is contained, and a term "outward" indicates a direction with respect to frames 43, 44 that is opposite to the direction facing toward the space in which the exposure unit is contained.

<Configuration of Image-Forming Apparatus>

Image-forming apparatus 1 is adapted to constitute a full-color printer of a tandem type, and contains an image-processing unit (not shown in the drawings) that performs image-processing on image data received from a device such as a scanner or a personal computer (not shown in the drawings), or received via a telephone line (not shown in the drawings), etc. Provided inside image-forming apparatus 1 are four image-forming units 2Y, 2M, 2C, 2K for yellow (Y), magenta (M), cyan (C), and black (K), respectively. Image-forming units 2Y, 2M, 2C, 2K are arranged generally in the horizontal direction so as to be spaced apart from each other and to extend in parallel, and vertical positions of image-forming units 2Y, 2M, 2C, 2K are respectively lower in this order (thus, the vertical position of image-forming unit 2Y is higher than that of image-forming unit 2K), whereby a plane in which image-forming units 2Y, 2M, 2C, 2K are arranged is inclined at a certain angle (e.g., 10 degrees) with respect to the horizontal direction. By this arrangement of image-forming units 2Y, 2M, 2C, 2K in a plane inclined at a certain angle with respect to the horizontal direction, the horizontal dimension is reduced in comparison with a case where image-forming units 2Y, 2M, 2C, 2K are arranged in a horizontal plane.

Each of the four image-forming units 2Y, 2M, 2C, 2K has basically the same structure, and contains photosensitive drum 3 that is driven to rotate at a certain speed by a drive unit (described later) and that serves as an image-holding member, primary charging roll 4 that charges a surface of photosensitive drum 3, developer unit 6 that develops, with toner, an electrostatic latent image formed on photosensitive drum 3 as a result of image exposure performed by image exposure unit 5 (described later), and cleaning unit 7 that cleans the surface of photosensitive drum 3. Photosensitive drum 3 is constituted, for example, of an organic photosensitive member having a cylindrical shape with a diameter of 30 mm, and having an overcoat layer on its surface. Photosensitive drum 3 is rotated by rotation of rotation shaft 3A (shown in FIGS. 3 and 4). Charging roll 4 is, for example, a roll-shaped charger constituted of a core bar coated with a conductive layer made of a synthetic resin or rubber and having an adjusted electric resistance, and a charging bias is applied to the core bar of charging roll 4. Further, a cleaning roll for removing foreign matters such as toner adhering to a surface of charging unit 4 is arranged to contact the surface of charging roll 4.

In the following description, where it is not necessary to distinguish between image-forming units 2Y, 2M, 2C, 2K, the image-forming units will be simply referred to as image-forming unit(s) 2.

Below image-forming units 2Y, 2M, 2C, 2K, exposure unit 5 is provided. Exposure unit 5 has four semiconductor laser units (not shown in the drawings) for emitting laser beams modulated in accordance with image data. The four laser beams emitted from these semiconductor laser units are deflected by a polygon mirror for scanning, and are irradiated onto photosensitive drum 3 of each image-forming unit 2Y, 2M, 2C, 2K via optical elements such as a lens and a minor (not shown in the drawings).

In this exemplary embodiment, exposure unit 5 extends along an underside of the four image-forming units 2Y, 2M, 2C, 2K, which are arranged in a plane inclined with respect to the horizontal direction. Thus, a length of a light path of the laser beam irradiated onto photosensitive drum 3 is the same for each of image-forming units 2Y, 2M, 2C, and 2K.

Image exposure unit 5, which is provided in common to each image-forming unit 2Y, 2M, 2C, 2K, receives image data of respective colors sequentially from the image-processing unit. The laser beam emitted from image exposure unit 5 in accordance with the image data is irradiated onto a surface of corresponding photosensitive drum 3 to form an electrostatic latent image thereon. The electrostatic latent images formed on photosensitive drums 3 are developed by developer units 6Y, 6M, 6C, 6K to form toner images of respective colors. The toner images of respective colors formed sequentially on photosensitive drums 3 of image-forming units 2Y, 2M, 2C, 2K are transferred one on top of another by primary transfer rolls 11 to intermediate transfer belt 10, which is arranged obliquely over the top of each image-forming units 2Y, 2M, 2C, 2K, and serves as an intermediate transfer member.

Intermediate transfer belt 10 is an endless belt-shaped member tension-supported by multiple rolls. Specifically, intermediate transfer belt 10 is wound around drive roll 12, backup roll 13, tension roll 14, and idler roll 15, such that intermediate transfer belt 10 is circulatingly moved in a direction indicated by an arrow in FIG. 1 by drive roll 12, which is rotated by a dedicated drive motor (not shown in the drawings) capable of maintaining a constant rotation speed. Intermediate transfer belt 10 has an upper moving section and a lower moving section, and the lower moving section is inclined with respect to the horizontal direction, with a downstream end of the lower moving section positioned lower than an upstream end of the same with respect to the direction of movement of the lower moving section. As intermediate transfer belt 10, a flexible film made of a synthetic resin, such as polyimide, may be used, where the ends of the synthetic resin film are connected by means of welding or the like to form an endless belt member. Intermediate transfer belt 10 is arranged such that the lower moving section is in contact with photosensitive drums 3Y, 3M, 3C, 3K of image-forming units 2Y, 2M, 2C, 2K.

It is to be noted that intermediate transfer belt 10, primary transfer rolls 11, drive roll 12, backup roll 13, tension roll 14, idler roll 15, etc., are integrated into a single unit referred to as intermediate transfer unit 9.

Recording sheets 18, having a prescribed size and being made of a prescribed material, and serving as recording media, are contained in sheet container 24 disposed inside image-forming apparatus 1, and are conveyed from sheet container 24 along conveyance path 21 formed by pairs of rollers. In this conveyance path 21, recording sheets 18 in sheet container 24 are conveyed, one sheet at a time, by means of sheet supply roll 25 and a pair of rolls 26 for sheet separation and conveyance to registration roll 28, and are temporarily stopped there. Then, recording sheet 18 is further conveyed to a secondary transfer position of intermediate transfer belt 10 by registration roll 28, which is rotated at a predetermined timing. Recording sheet 18, on which the toner images of respective colors have been transferred at the secondary transfer position, is applied with a heat and pressure by fixing unit 19 to fix the toner images. Thereafter, recording sheet 18 passes through exit roll 20 of fixing unit 19, and is discharged by discharge roll 22 onto sheet-receiving tray 23 provided at an upper portion of image-forming apparatus 1.

At a position on conveyance path 21 that is opposed to backup roll 13 across intermediate transfer belt 10 is provided secondary transfer roll 17, which is constituted of a rotating member and is urged against intermediate transfer belt 10. When recording sheet 18 moves between secondary transfer roll 17 and intermediate transfer belt 10, secondary transfer roll 17 presses recording sheet 18 against intermediate transfer belt 10, whereby the toner images of yellow (Y), magenta (M), cyan (C), and black (K), which have been overlappingly transferred onto intermediate transfer belt 10, are transferred onto recording sheet 18 owing to pressure and electrostatic force. The position at which secondary transfer roll 17 and backup roll 13 are opposed to each other across intermediate transfer belt 10 is the above-mentioned secondary transfer position.

Arranged between sheet-receiving tray 23 and intermediate transfer belt 10 are toner cartridges 29Y, 29M, 29C, 29K. Toner cartridges 29Y, 29M, 29C, and 29K supply toner to developer units 6Y, 6M, 6C, and 6K, respectively.

<Configuration of Housing>

Figure 2:
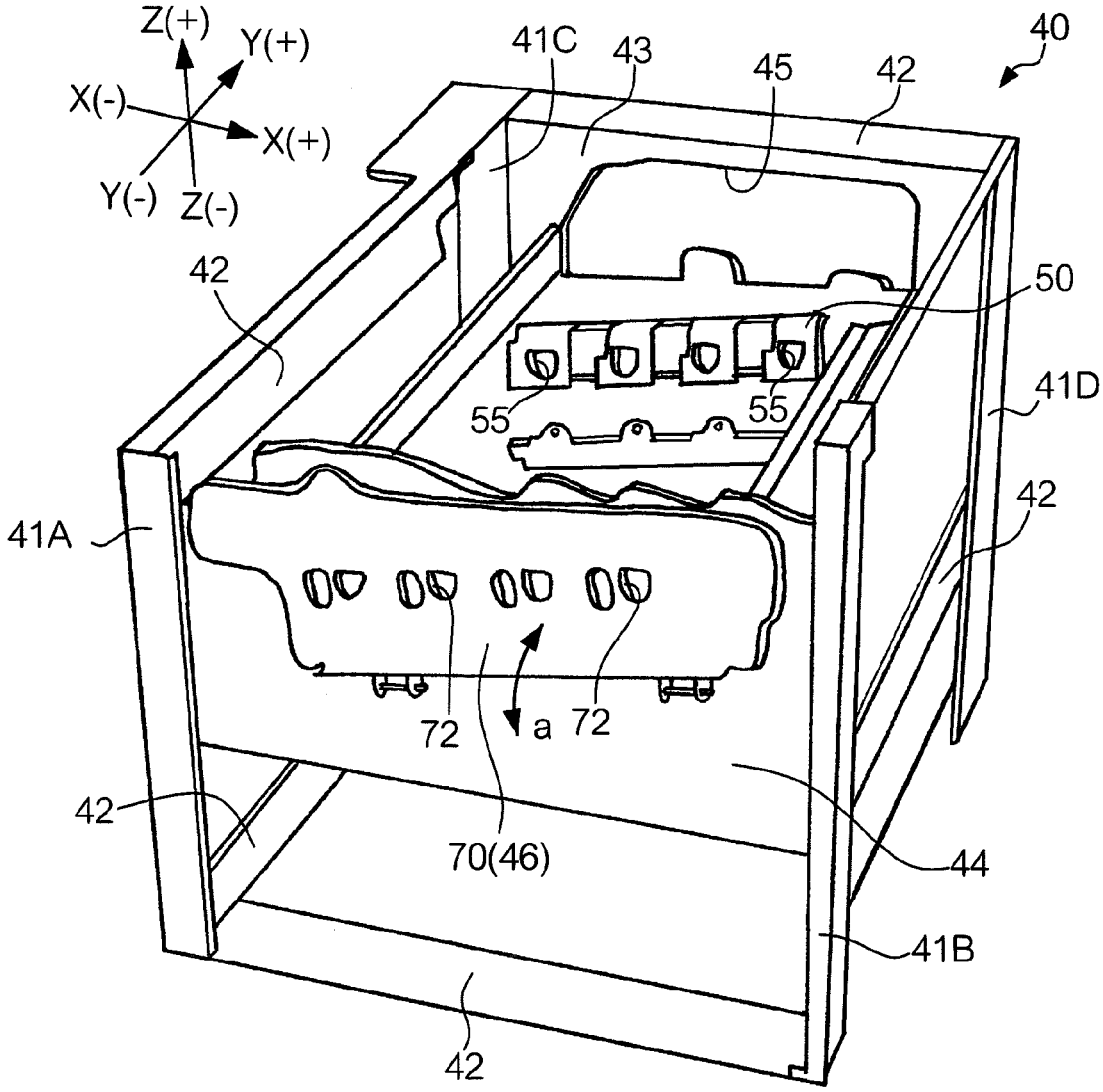
FIG. 2 is a perspective view showing a configuration of a housing.

Next, explanation will be made of a configuration of main body (or housing) 40 of image-forming apparatus 1, with reference to FIG. 1 and FIG. 2. FIG. 2 is a perspective view schematically showing a configuration of main body 40, which constitutes a base of image-forming apparatus 1.

As shown in FIG. 2, main body 40 includes four pillars 41A-41D extending in the vertical direction (Z-axis direction), and plural beams 42 connecting pillars 41A-41D. Further, back frame 43 serving as a first frame member is provided between upper parts of back-side (or Y(+) side) pillars 41C, 41D, and front frame 44 serving as a second frame member is provided between upper parts of front-side (or Y(−) side) pillars 41A, 41B. Front frame 44 is provided with a front cover 46 that is moveable in directions indicated by arrow "a" to open and close a space for containing image-forming units 2 (photosensitive drums 3) therein with respect to an outside. Image-forming units 2 are contained in the space so as to be removable in a direction opposite to a direction of insertion (Y-axis direction). Each image-forming unit 2 is inserted into the space for containment in a direction from the front side (Y(−) side) to the back side (Y(+) side), and is drawn out from the space for removal in a direction from the back side (Y(+) side) to the front side (Y(−) side).

Back frame 43 is provided on its inner surface (a surface facing in Y(−) direction) with first supporting plate 50 serving as a first supporting unit, and front cover 46 of front frame 44 includes second supporting plate 70. Though not shown in the drawings, front cover 46 may have an outer plate-shaped member made of plastic or the like attached to an outer surface (or a surface facing in Y(−) direction) of second supporting plate 70. Further, as shown in FIG. 1, main body 40 includes upper partition plate 47 that extends between frames 43 and 44 of main body 40 at a position above image exposure unit 5 (or a position on a Z(+) side of exposure unit 5), to define a space in which exposure unit 5 is accommodated, where upper partition plate 47 is secured to frames 43 and 44 by means of welding or the like.

<Configuration of Supporting Plate>

Figure 3:
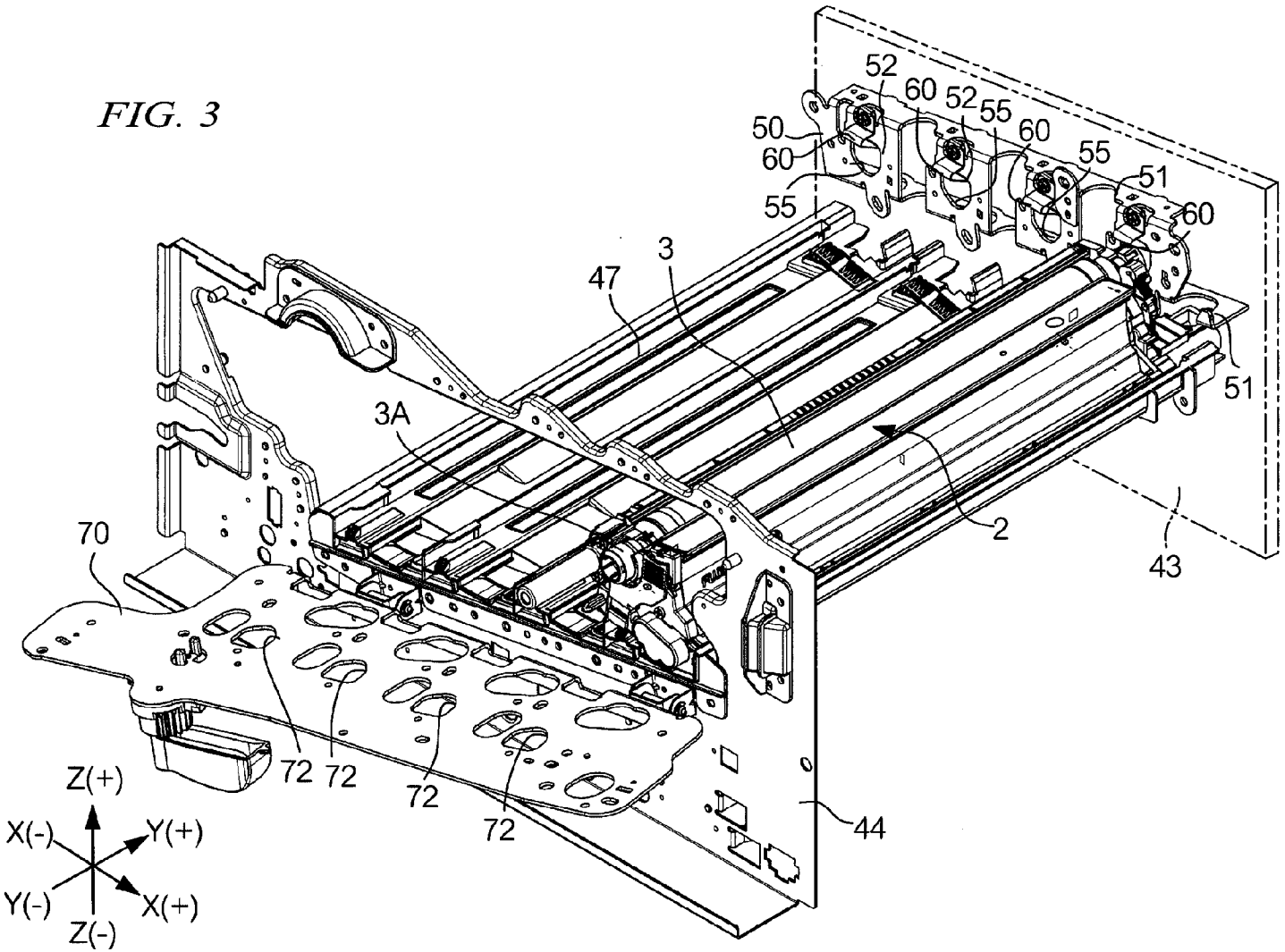
FIG. 3 is a perspective view showing an image-forming unit installed in the housing.

Explanation will now be made of a configuration of first supporting plate 50 with reference to FIGS. 3-5. FIG. 3 is a perspective view showing image-forming unit 2 installed in main body 40 of image-forming apparatus 1, FIG. 4 is a perspective view showing a configuration of first supporting plate 50 and flat spring 60, and FIG. 5 shows flat spring 60 attached to insertion hole 55.

As shown in FIGS. 3 and 4, first supporting plate 50 is constituted of a generally rectangular plate member, which is bent along its longitudinal sides to form ribs 51, 51 extending outward (in Y(+) direction). First supporting plate 50 further includes four planar portions 52, . . . , 52, which extend in the X-Z plane and are connected by ribs 51, 51. In each planar portion 52, insertion hole 55 for receiving rotation shaft 3A of corresponding photosensitive drum 3 is formed. A part of each planar portion 52 positioned above insertion hole 55 (Z(+) side) serves as spring attachment part 53 where attachment part 61 of flat spring 60 is attached to a front surface (Y(−) side) of planar portion 52 in surface-to-surface contact. A coupling is formed on one end of each rotation shaft 3A to engage with a gear of a drive unit not shown in the drawings.

First supporting plate 50 is secured to back frame 43 by fixing of an end of each rib 51 to an inner surface (Y(−) side) of back frame 43 by means of laser welding or the like.

Next, explanation will be made of a configuration of flat spring 60, which serves as a flat elastic body. As shown in FIG. 4, flat spring 60 is formed by bending a plate-shaped spring member such that a portion of flat spring 60 between attachment part 61, which serves as a base part, and a free end part has a cross-section in a shape of a chevron. More specifically, flat spring 60 is bent to form leg part 62 extending in the frontward direction (Y(−) direction) from attachment part 61, and at bending part 63, further bent in the opposite direction to form spring part 64, which serves as an elastic part. Spring part 64 extends through insertion hole 55 in the backward direction (Y(+) direction), and pressing part 65 for pressing rotation shaft 3A from radially outside is formed in spring part 64 at a position spaced apart from insertion hole 55 in the backward direction (Y(+) direction). In this flat spring 60, spring part 64 has a larger length than leg part 62, whereby pressing part 65 is positioned to be spaced apart from a back surface of first supporting plate 50.

Figures 4A, 4B:
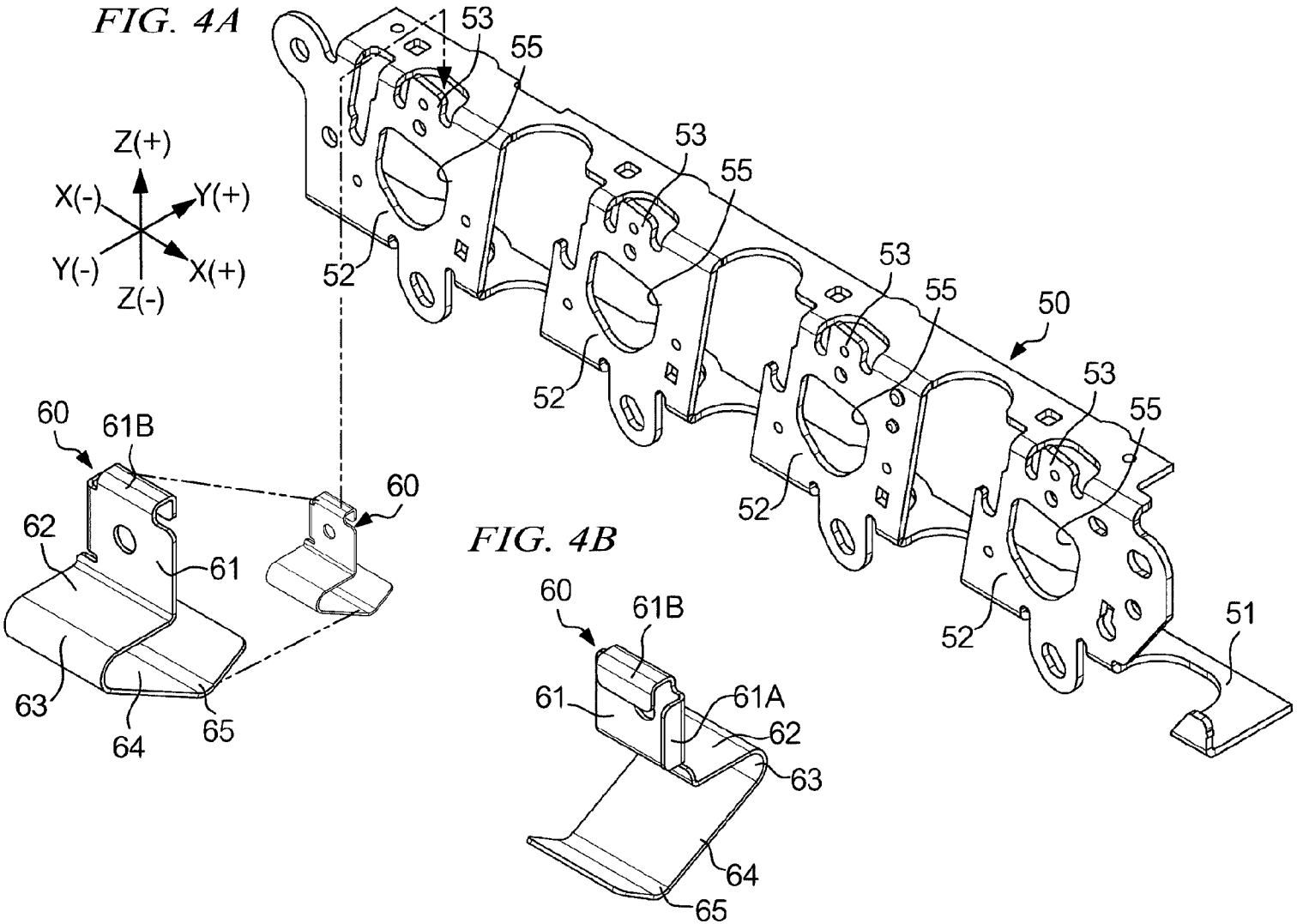
FIG. 4A is a perspective view showing a structure of a first supporting plate and a flat spring.
FIG. 4B is a perspective view showing a back side of the flat spring.
Figure 5:
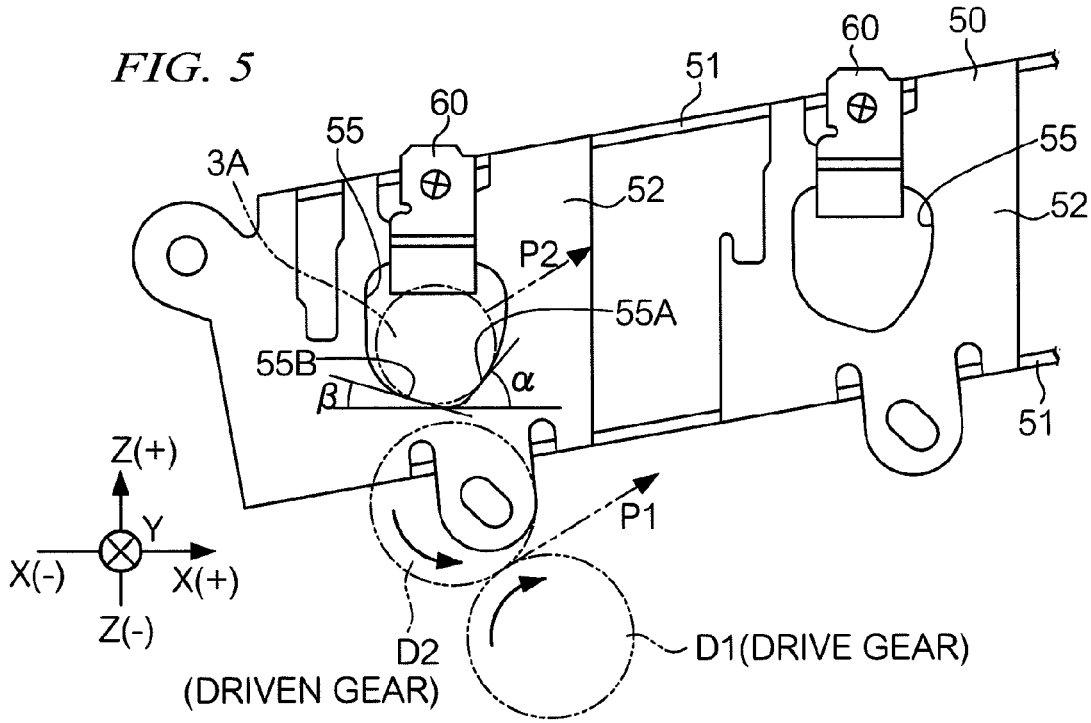
FIG. 5 shows a flat spring attached to an insertion hole.

As shown in FIG. 4B, which shows a back side of flat spring 60, rib 61A is formed on a left side (X(−) side) of attachment part 61 to limit movement in the rightward direction (X(+) direction). Flat spring 60 also has bend 61B formed along an upper side (Z(+) side) of attachment part 61 to limit movement in the frontward/backward direction (Y-axis direction) and in the downward direction (Z(−) direction). With rib 61A and bend 61B engaging spring attachment part 53, flat spring 60 is secured to first supporting plate 50 by means of a screw to be in surface-to-surface contact with spring attachment part 53. In this way, even when image-forming unit 2 is inserted into the space with a large momentum, damage to flat spring 60 and first supporting plate 50 can be made smaller in comparison with a case where the attachment parts are not secured to each other in surface-to-surface contact. Also, when flat spring 60 is attached or when replacement of flat spring 60 becomes necessary due to damage, front cover 46 is opened to expose the space to outside, whereby the attachment or replacement can be carried out easily via the space.

Further, because spring attachment part 53 to which flat spring 60 is attached is provided on an inward-facing side (Y(−) side), leg part 62 and bending part 63 are positioned inside main body 40, whereby image-forming apparatus 1 can be smaller and requires less space for installation in comparison with a case where flat spring 60 is attached to an outward-facing side.

Figures 6A, 6B, 6C:
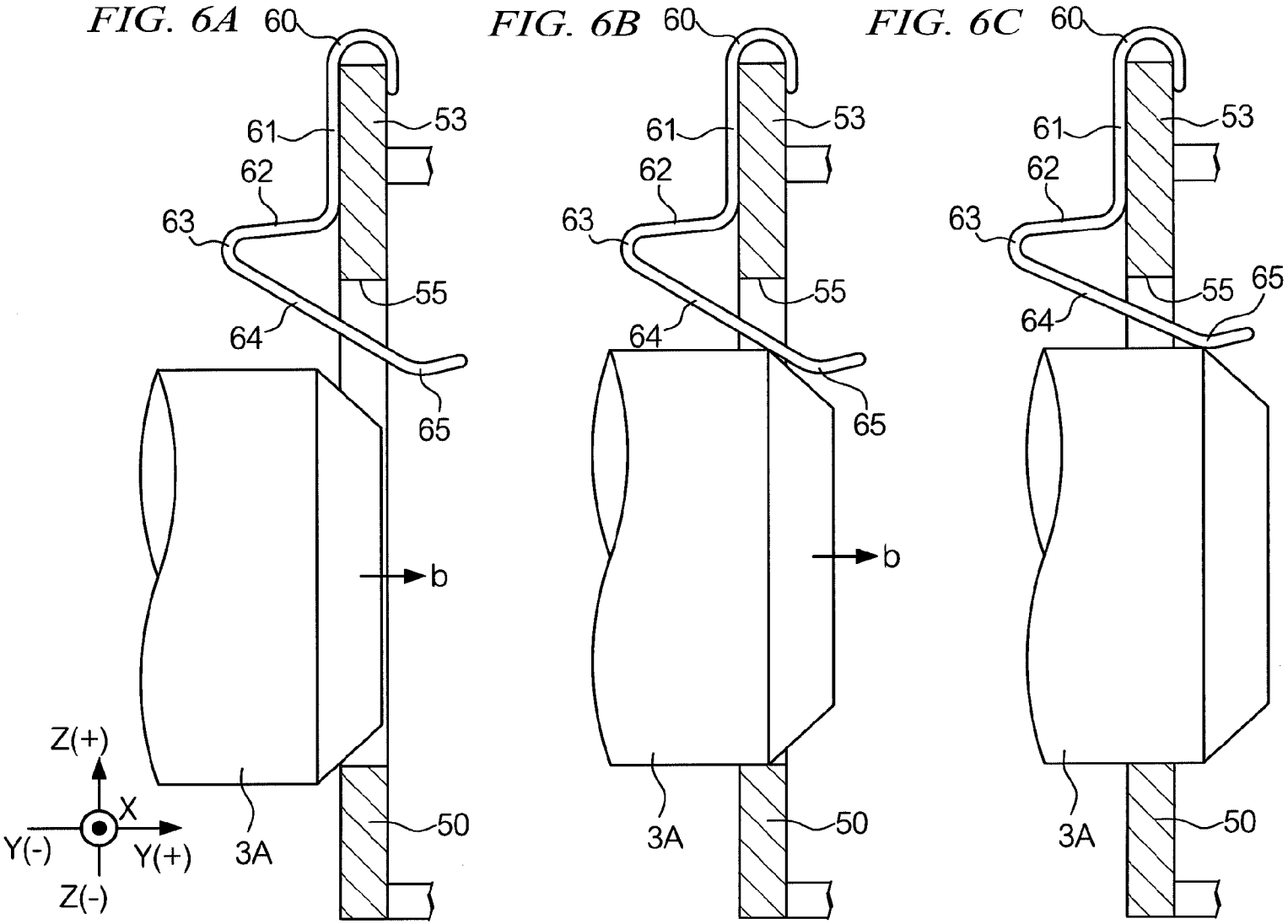
FIGS. 6A-6C are explanatory views showing a rotation shaft being inserted into an insertion hole.

Further, as shown in FIGS. 6A-6C, an upper edge of insertion hole 55 of spring attachment part 53 is positioned lower (Z(−) side) than attachment part 61 of flat spring 60. Thus, spring attachment part 53 also serves as a stopper that prevents spring part 64, pushed by rotation shaft 3A, from being bent excessively.

Figure 7:
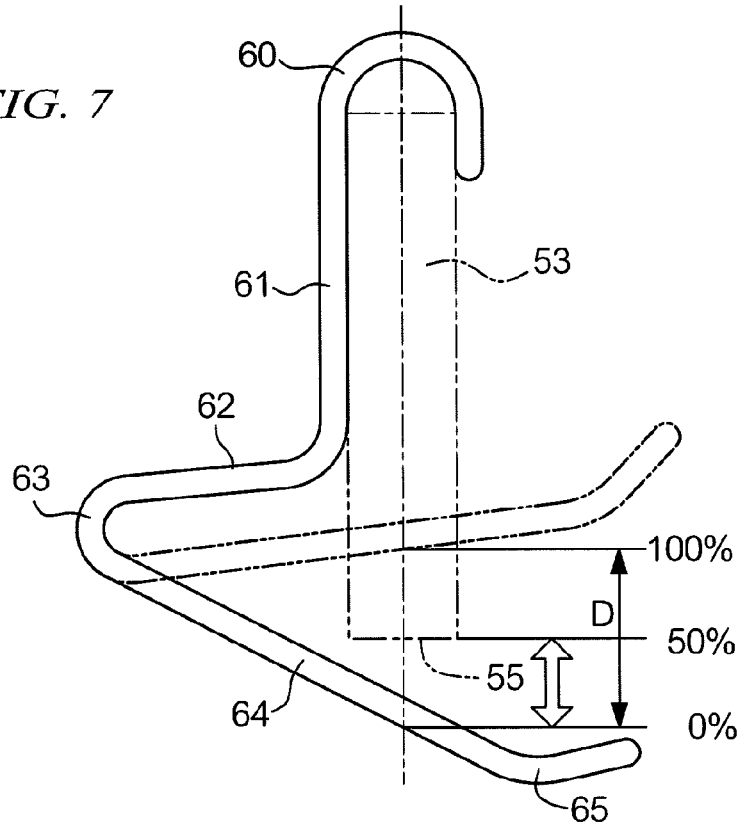
FIG. 7 is a view for explaining a relationship between a flat spring and an upper edge of an insertion hole.

Explanation will now be made of a relationship between flat spring 60 and the upper edge of insertion hole 55, with reference to FIG. 7. Range D indicates a range of elastic deformation of flat spring 60, within which spring part 64 can flex elastically relative to leg part 62. In other words, if the flexion exceeds the range of elastic deformation, a plastic deformation will be caused, whereby flat spring 60 will become unable to function as a spring. For these reasons, in this exemplary embodiment, where the flexion of flat spring 60 to the maximum limit of elastic deformation is represented as 100%, flat spring 60 is used in a range between 0% and 50%. Accordingly, the upper edge of insertion hole 55 is positioned within range D.

On the other hand, as shown in FIGS. 2 and 3, second supporting plate 70 is made of a substantially rectangular plate member that is larger than first supporting plate 50. Second supporting plate 70 is formed with insertion holes 72 at positions opposed to insertion holes 55 of first supporting plate 50, respectively, when front cover 46 is closed, such that each insertion hole 72 has the same shape as that of insertion hole 55.

First supporting plate 50 and second supporting plate 70 are composed of metallic plates made of the same material and having the same thickness. When insertion holes 55, 72 are bored, the boring is performed on first supporting plate 50 and second supporting plate 70 stacked one over the other. In this way, burrs and distortions that may be generated as a result of the boring can be substantially the same between corresponding insertion holes 55, 61. This contributes to suppressing any positional misalignment between the ends of each rotation shaft 3A.

Insertion holes 55, 72 are formed in supporting plates 50, 70, respectively, such that insertion holes 55, 72 are arranged at an angle equal to the angle of arrangement of image-forming units 2 with respect to the horizontal direction (e.g., 10 degrees).

As shown in FIG. 5, each insertion hole 55 (72) has a substantially pentagonal shape, such that oblique edge segments 55A, 55B in a lower (Z(−) side) part thereof have different angles of inclination with respect to the horizontal direction (X-axis direction). Specifically, angle of inclination $\alpha$ of oblique edge segment 55A (first edge segment) is larger than angle of inclination $\beta$ of oblique edge segment 55B (second edge segment), whereby oblique edge segment 55B is positioned lower in the direction of gravity. Consequently, an end portion of rotation shaft 3A received in insertion hole 55 contacts oblique edge segments 55A and 55B such that a tangential line of the end portion of rotation shaft 3A at a point contacting oblique edge segment 55A is inclined with respect to the horizontal direction at an angle larger than that at which a tangential line of the end portion of rotation shaft 3A at a point contacting oblique edge segment 55B is inclined with respect to the horizontal direction. The reason the oblique edge segments have different angles of inclination is that a force that urges image-forming unit 2 to shift is transmitted to image-forming unit 2 from a drive unit for rotating rotation shaft 3A.

Specifically, a drive unit including multiple gears is provided on the back side (Y(+) side) of back frame 43. When a rotational force is transmitted from drive gear D1 to driven gear D2 of the drive unit, where driven gear D2 may serve to rotate rotation shaft 3A or a rotation shaft other than rotation shaft 3A, force P1 that urges driven gear D2 to shift is generated in a tangential direction between gears D1 and D2. This force P1 also acts similarly on rotation shaft 3A as force P2. Therefore, each rotation shaft 3A is required to be positioned so as to be urged downward (in Z(−) direction) even when force P2 is applied thereto. To achieve this, oblique edge segment 55B having a smaller angle of inclination is formed upstream with respect to a direction of force P2 (or upstream with respect to a direction of rotation of rotation shaft 3A) compared to oblique edge segment 55A having a larger angle of inclination. It is to be noted here that a determination as to whether one circumferential portion of insertion hole 55 is positioned upstream or downstream of another circumferential portion of insertion hole 55 is made in accordance with a region defined between the two circumferential portions that corresponds to a smaller angle of circumference determined by the two circumferential portions. In this way, owing to its own weight, rotation shaft 3A contacts oblique edge segment 55B with a larger force than that with which it contacts oblique edge segment 55A. Further, because flat spring 60 is provided in an upper part (Z(+)-side part) of insertion hole 55, the spring force generated by flat spring 60 acts on rotation shaft 3A from radially outside via pressing part 65, to push rotation shaft 3A against oblique edge segment 55B with a larger force than that exerted against oblique edge segment 55A. Thus, each rotation shaft 3A is pressed against oblique edge segment 55B that is positioned lower in the direction of gravity, whereby a positional shift of each rotation shaft 3A is suppressed.

Next, with reference to FIGS. 6A-6C, explanation will be made of an operation of flat spring 60. FIGS. 6A-6C are explanatory views showing an operation of flat spring 60 during an insertion of rotation shaft 3A into insertion hole 55.

As shown in FIG. 6A, spring part 64 of flat spring 60 extends through insertion hole 55 such that pressing part 65 is positioned on a back side (Y(+) side) of first supporting plate 50. When rotation shaft 3A (image-forming unit 2) is inserted in a direction indicated by arrow b, an end of rotation shaft 3A abuts a lower (Z(−) side) edge of insertion hole 55. As rotation shaft 3A is inserted further in the direction of arrow b, as shown in FIG. 6B, rotation shaft 3A is moved upward (in Z(+) direction) such that an upper part of rotation shaft 3A contacts spring part 64 of flat spring 60. Accordingly, flat spring 60 is bent at bending part 63, and spring part 64 gradually exerts a spring force in the downward direction (Z(−) direction). In a state that rotation shaft 3A has been inserted into insertion hole 55, as shown in FIG. 6C, pressing part 65 is positioned to push rotation shaft 3A in the radial direction, and flat spring 60 applies a spring force upon rotation shaft 3A to press it downward (in Z(−) direction). In this way, flat spring 60 serves to position rotation shaft 3A in insertion hole 55.

From experimental results, the spring force applied by flat spring 60 on rotation shaft 3A is preferably in a range from 0.5 to 3.0 (N) for steadily holding rotation shaft 3A in insertion hole 55 while allowing rotation shaft 3A to be inserted into insertion hole 55 without excessive force. More preferably, the spring force applied by flat spring 60 on rotation shaft 3A is in a range from 1.5 to 2.0 (N).

Thus, flat spring 60 is provided to each insertion hole 55 of first supporting plate 50 for supporting respective rotation shaft 3A (photosensitive drum 3 or image-forming unit 2) in a back portion of image-forming apparatus 1 such that flat spring 60 is attached on a frontward-facing surface (Y(−) side) of first supporting plate 50 and spring part 64 extends from bending part 63 in the backward direction (Y(+) direction) to a position on a back side of first supporting plate 50. In such a structure, when rotation shaft 3A is inserted into insertion hole 55, an impact generated from abutment of rotation shaft 3A to insertion hole 55 is absorbed by flat spring 60, and thus the impact is reduced compared to a case where flat spring 60 is absent.

In a state after rotation shaft 3A has been inserted into insertion hole 55, the spring force of flat spring 60 pushes down rotation shaft 3A to prevent rotation shaft 3A from floating in insertion shaft 55, whereby a change in the support position of rotation shaft 3A of photosensitive drum 3 is prevented, and hence misalignment of toner images of various colors is avoided.

2. Modified Embodiments

The foregoing exemplary embodiment may be modified as described in the following.

<2-1>

In the foregoing exemplary embodiment, flat springs 60 are provided to first supporting plate 50 that supports each rotation shaft 3A in a back portion of main body 40 in the direction of insertion. However, flat springs 60 may be provided to insertion holes 72 of second supporting plate 70 of front cover 46, or to each of insertion holes 55 and 72.

<2-2>

In the foregoing exemplary embodiment, rotation shaft 3A is supported by first supporting plate 50 in a back portion of main body 40, and the forward end of rotation shaft 3A is supported by second supporting plate 70 of front cover 46. However, the present invention may be applied to a case where rotation shaft 3A is supported only by first supporting plate 50 in a cantilever manner.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

a housing including a first frame member and a second frame member opposed to the first frame member;

a plurality of image-forming units each including an image-holding member on which an image is formed, the image-holding member having a rotation shaft;

a supporting unit provided to the first frame member, the supporting unit having a plurality of insertion holes each receiving and supporting an end portion of a rotation shaft of a corresponding one of the plurality of image-holding members inserted in an insertion direction from the second frame member to the first frame member; and a plurality of flat elastic bodies provided to the respective insertion holes, each flat elastic body having a plate member that is bent to form:

an attachment part that is attached to a surface of the supporting unit facing in a direction opposite to the insertion direction;

a leg part extending from the attachment part in the direction opposite to the insertion direction; and an elastic part extending from the leg part in the insertion direction through the insertion hole to press the end portion of the rotation shaft against an edge of the insertion hole at a position spaced apart from the insertion hole in the insertion direction.

2. The image-forming apparatus according to claim 1, wherein when viewed in an axial direction, the end portion of each rotation shaft received in the corresponding insertion hole contacts first and second circumferential portions of the insertion hole such that a tangential line of the end portion of the rotation shaft at the first circumferential portion is inclined with respect to a horizontal direction at an angle larger than that at which a tangential line of end portion of the rotation shaft at the second circumferential portion is inclined with respect to the horizontal direction, the second circumferential portion being positioned upstream of the first circumferential position with respect to a direction of rotation of the rotation shaft.

3. The image-forming apparatus according to claim 2, wherein the attachment part of each flat elastic body is attached to a corresponding portion of the supporting unit in surface-to-surface contact.

4. The image-forming apparatus according to claim 1, wherein the attachment part of each flat elastic body is attached to a corresponding portion of the supporting unit in surface-to-surface contact.

* * * * *